US009856756B2

(12) United States Patent
Hoetger et al.

(10) Patent No.: US 9,856,756 B2
(45) Date of Patent: Jan. 2, 2018

(54) WORKING MEDIUM MIXTURE FOR STEAM ENGINES

(71) Applicant: AMOVIS GmbH, Berlin (DE)

(72) Inventors: Michael Hoetger, Berlin (DE); Jörg Collisi, Berlin (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 0 days.

(21) Appl. No.: 14/427,131

(22) PCT Filed: Sep. 2, 2013

(86) PCT No.: PCT/EP2013/068085
§ 371 (c)(1),
(2) Date: Mar. 10, 2015

(87) PCT Pub. No.: WO2014/040875
PCT Pub. Date: Mar. 20, 2014

(65) Prior Publication Data

US 2015/0240668 A1 Aug. 27, 2015

(30) Foreign Application Priority Data

Sep. 11, 2012 (DE) ..... 10 2012 108 468

(51) Int. Cl.

| | |
|---|---|
| ***F01K 25/06*** | (2006.01) |
| ***C09K 5/00*** | (2006.01) |
| ***C09K 5/08*** | (2006.01) |
| ***F01K 25/08*** | (2006.01) |
| ***F01K 9/00*** | (2006.01) |

(52) U.S. Cl.
CPC ..... *F01K 25/06* (2013.01); *F01K 9/003* (2013.01); *F01K 25/08* (2013.01)

(58) Field of Classification Search
CPC ..... F01K 9/003; F01K 25/06; F01K 25/08
USPC ..... 60/649
See application file for complete search history.

(56) References Cited

U.S. PATENT DOCUMENTS 4,422,297 A * 12/1983 Rojey ..... F01K 25/06 60/651
8,703,690 B2 * 4/2014 Van Horn ..... C09K 5/044 252/67

(Continued)

FOREIGN PATENT DOCUMENTS

DE 10226445 C1 6/2003
WO WO 2005/001248 A1 1/2005

OTHER PUBLICATIONS

Azeotropes from A to Z, WAAC Newsletter vol. 28 No. 2, May 2006.*

*Primary Examiner* — Mark Laurenzi
*Assistant Examiner* — Deming Wan
(74) *Attorney, Agent, or Firm* — Lazaris IP

(57) ABSTRACT

The invention relates to the use of a working medium in steam power plants having a steam generator for generating working medium vapor, a pump for generating an increased pressure in the working medium vapor, an expansion machine for generating mechanical and/or electrical work by expansion of the working medium from an elevated pressure to a lower pressure level under working conditions and a condenser for condensing the working medium, wherein the working medium contains a lubricant. The invention is characterized in that the working medium contains acetone and a lubricant.

3 Claims, 1 Drawing Sheet

(56) References Cited

U.S. PATENT DOCUMENTS

| | | | | |
|---|---|---|---|---|
| 2006/0010872 | A1* | 1/2006 | Singh | F01K 25/08 60/671 |
| 2006/0277910 | A1 | 12/2006 | Hoetger | |
| 2009/0314015 | A1* | 12/2009 | Minor | C09K 5/045 62/115 |

* cited by examiner

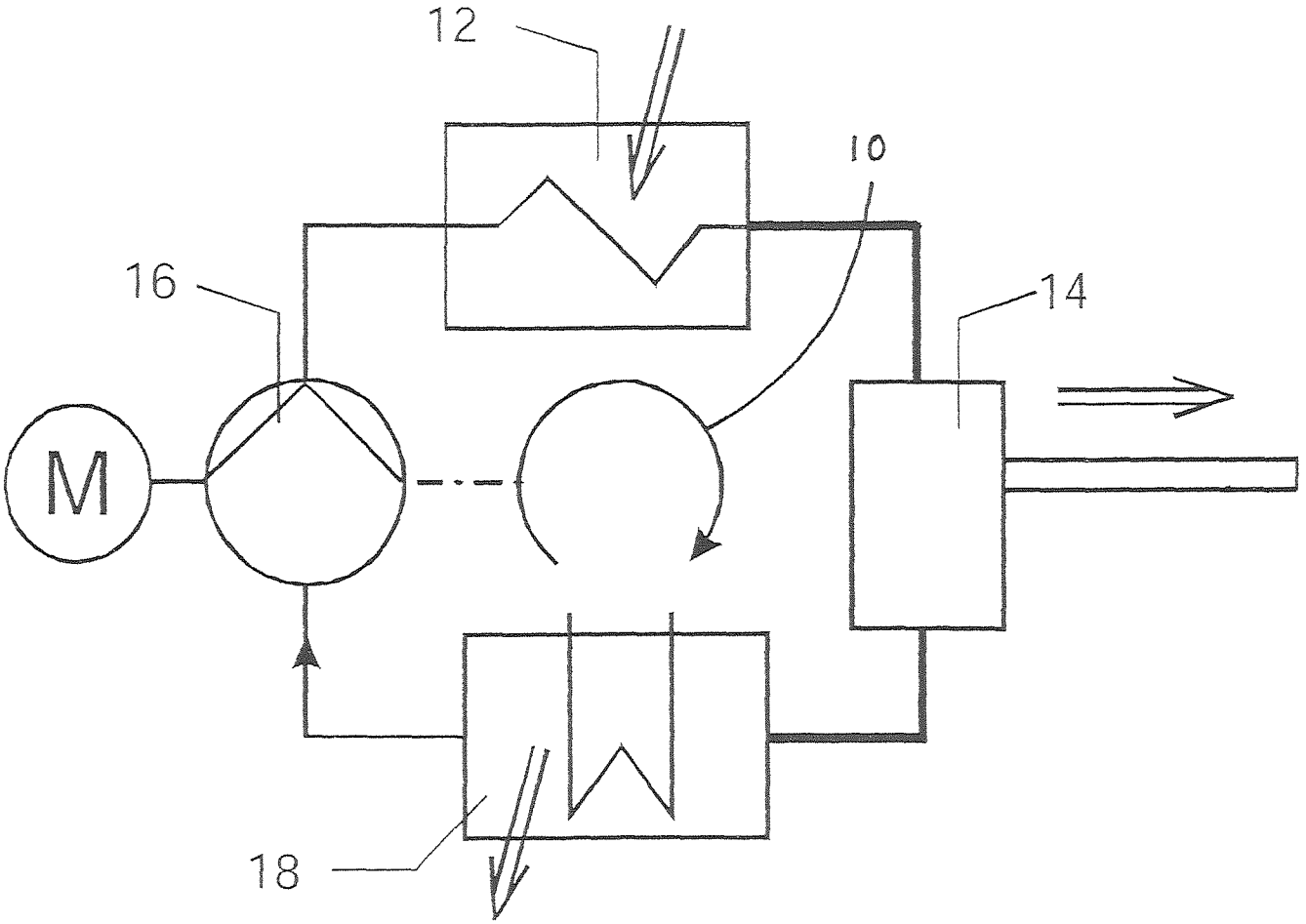
12
10
14
16
M
18

WORKING MEDIUM MIXTURE FOR STEAM ENGINES

CROSS REFERENCE TO RELATED PATENT APPLICATIONS

This patent application is filed herewith for the U.S. National Stage under 35 U.S.C. §371 and claims priority to PCT application PCT/EP2013/068085, with an international filing date of Sep. 2, 2013. The contents of this application are incorporated in their entirety herein.

STATEMENT REGARDING FEDERALLY-SPONSORED RESEARCH OR DEVELOPMENT

Not applicable.

TECHNICAL FIELD

The invention relates to the use of a working medium mixture in steam engines with a steam generator for the generation of working medium steam, a pump for the generation of an increased pressure in the working medium steam, an expansion engine for the generation of mechanical and/or electric energy by expanding the working medium mixture from an increased pressure to a lower pressure level with releasing energy and a condenser for condensing the working medium wherein the working medium comprises a lubricant.

In a steam cycle thermal energy can be transferred to a working medium by means of a steam generator. The thermal energy comprised in the working medium is converted to mechanic energy in a power engine. The power engine may be an expansion engine, where the working medium is expanded releasing energy.

Commonly, the steam generator is formed by a heat exchanger where a working medium is flowed through for heat absorption. The working medium is present in the form of a fluid. The fluid, such as, for example water or water steam, is flowed through one or more channels which are exposed to a hot gas flow. The hot gas flow can be hot combustion gas of a burner where a fuel is exothermally combusted or the waste heat of a combustion engine. When the channels with fluid flow are exposed to a hot gas flow heat is transferred to the fluid which will evaporate and overheated. When leaving the steam generator the working medium has a high pressure and temperature level in the range of several hundred ° C.

In the expansion engine, such as a reciprocating or rotary piston engine, the working medium is expanded from a first, high pressure level to a lower second pressure level with energy output. The piston will drive a shaft which in turn drives an electric generator, for example, or serves to drive a vehicle. The expanded fluid is cooled in a condenser and fluidifyed and returned to the fluid cycle by a pump. The higher the pressure and temperature difference, the higher is the efficiency of the assembly.

An expansion engine is defined here as any power engine which operates with a working medium in the form of gas or steam with phase change. Power engines with internal combustion, such as, for example, a two-stroke engine, where fuel is combusted inside the power engine, is something different. Usually, water steam is used as working medium which is expanded providing energy. A combustion is effected outside the power engine in order to evaporate water. A consecutive condenser assembly serves to fluidify the expanded working medium. Typical temperatures of the working medium are 550° C. for the energized steam state and 100° C. as condensing temperature.

BACKGROUND OF THE INVENTION

Such a steam cycle is known from, for example, DE 10226445 C1 or WO 2005/001248 A1. A cycle of the above mentioned kind is described there. Feed water is used as a working medium. Water is easy to handle, cheap and has good thermodynamic properties. The water is evaporated in a vaporizer. The steam is expanded in an expansion engine providing energy. After expansion the steam is condensed in a condenser and by means of a pump fed to a reservoir where it is available again for the cycle. The described power engine is used, for example, as an auxiliary power engine in motor vehicles.

BRIEF SUMMARY OF THE INVENTION

It is an object of the invention to provide a working medium of the above mentioned kind which improves the efficiency of the steam power engine.

According to the invention, this object is achieved in that the working medium comprises acetone and a lubricant. Acetone is also called propanone, 2-propanone, dimethyl ketone or propane-2-on. It is known as a degreasing agent, for tooth cleaning by dentists, as nail polish remover and diluent. The invention is based on the surprising finding that the efficiency of a steam engine is improved by the addition of acetone. The polarity properties of acetone improve the stability of the solution with the individual components and the lubricant. The lubricant is more soluble. The expansion engine is then better lubricated and has less friction losses. Thereby, the efficiency is improved. Furthermore, an expensive and complex separation device for separating the working medium from the lubricant is not necessary anymore.

Preferably, the working medium comprises pentane or another medium influencing the boiling performance. Lubricants, such as polyalphaolefines PAO, polyalkyleneglycols PAG, silicon oils, esters or polyethyleneglycols PEG, are particularly well suitable for the purpose. Particularly good efficiencies are achieved if the lubricant is present in an amount between 2 to 20 mass percent (mass-%).

The above described working medium mixture in the form of a stable emulsion or solution is also well suited for high pressure and high temperature ranges as they occur in typical steam cycles.

Further modifications are subject matter of the subclaims. Embodiments are described below with reference to the accompanying drawing.

BRIEF DESCRIPTION OF THE SEVERAL VIEWS OF THE DRAWINGS

FIG. 1 schematically shows a steam cycle.

DETAILED DESCRIPTION OF THE INVENTION

FIG. 1 schematically shows a steam cycle 10 with an expansion engine 14. The steam cycle comprises an expansion engine 14 and a flow steam generator 12. The flow steam generator 12 is exposed to the hot exhaust gas of a burner. The cycle also comprises a feed-water pump 16 with adjustable frequency and a condenser 18. A working medium with additives flows through the flow steam generator 12. The working medium has an increased pressure generated by a pump 16. The working medium or working medium steam obtains a heat quantity $\Phi_H$ from the exhaust gas. Thereby, the working medium steam is overheated, i.e. brought to a high temperature. The internal energy increases. The working medium steam is expanded in an expansion engine 14. Thereby, the pressure sinks to a lower pressure level. With such expansion, energy is released. The expanded working medium steam is fed to a condenser 18 where it is condensed in order to be available again for the cycle. A heat amount $\Phi_C$ is release δ which can be, for example, used for heating purposes. The condensed working medium is again fed to the pump 16.

In a first embodiment the working medium is pure acetone with a boiling point at 56° C. with 15 mass-% lubricant. In an alternative embodiment the working medium is a mixture of 65 mass-% pentane, 18 mass-% acetone, 5 mass-% water and 12 mass-% polyalphaolefine PAO. This mixture boils at a temperature of 32° C.

In a further, alternative embodiment the working medium is a mixture of 50 mass-% acetone, 35 mass-% hexane and 15 mass-% lubricant. This mixture boils at a temperature of 50° C. It is thermally stable up to a temperature of 400° C. Therefore, it is possible to operate with a large temperature difference between steam and condensed liquid whereby a high efficiency is obtained.

What is claimed is:

1. A method of using a working medium mixture in steam engines comprising:

generating a working medium steam of said working medium mixture in a steam generator, said working medium steam having a pressure and a temperature;

increasing said pressure in said working medium steam in a pump;

generating mechanical and/or electric energy in an expansion engine by expanding said working medium steam from said increased pressure to a lower level of said pressure while releasing energy; and condensing said working medium steam in a condenser, wherein said working medium mixture comprises a lubricant comprising at least 15% of the working medium mixture and acetone in an amount comprising between 18 and 85 mass-% of the working medium mixture so that the working medium mixture has a boiling point of between 32° C. and 56° C., the acetone having a polarity that stabilizes the working medium mixture when mixed with the lubricant to enable operation of the steam engine where a large temperature difference exists between the working medium steam and condensed working medium mixture, and wherein the lubricant is a mixture that includes one or more of a polyalphaolefine, a polyalkyleneglycol, and a polyethyleneglycol, in combination with a silicon oil or ester.

2. The method of claim 1, the working medium mixture comprising pentane, hexane, alcohol, water or another medium influencing said boiling point.

3. The method of claim 1, and wherein said lubricant is present in an amount between 2 to 20 mass-%.

* * * * *